United States Patent [19]

Vander Lugt, Jr.

[11] 4,125,633

[45] Nov. 14, 1978

[54] BACON OR LIKE CONTAINER, BLANK THEREFOR, BACON PACKAGE AND METHOD OF PACKAGING BACON THEREIN

[75] Inventor: Thomas Vander Lugt, Jr., Kalamazoo, Mich.

[73] Assignee: Brown Company, Kalamazoo, Mich.

[21] Appl. No.: 712,143

[22] Filed: Aug. 6, 1976

[51] Int. Cl.[2] ..... B65D 85/00

[52] U.S. Cl. ..... 426/121; 53/461; 93/35 R; 206/45.31; 229/87 F; 426/124; 426/411

[58] Field of Search ..... 229/87 F, 40, 30, 32, 229/34 R, ; 206/45.31, 424; 426/121, 122, 129, 124, 411; 53/32; 93/35 R

[56] References Cited

U.S. PATENT DOCUMENTS

| | | | |
|---|---|---|---|
| Re. 28,460 | 7/1975 | Rous | 229/40 |
| 2,283,949 | 5/1942 | Ringler | 229/34 |
| 2,565,976 | 8/1951 | Mayer et al. | 229/87 F |
| 2,595,678 | 5/1952 | Levkoff | 206/45.31 |
| 2,724,541 | 11/1955 | Metcalf | 206/45.13 X |
| 2,940,861 | 6/1960 | Hultkrans | 229/87 F |
| 3,137,435 | 6/1964 | Meyers | 229/87 F |
| 3,309,005 | 3/1967 | Pilger | 229/517 S |
| 3,803,332 | 4/1974 | Seiferth et al. | 229/87 F |
| 3,814,235 | 6/1974 | Glaze | 206/45.31 |
| 3,835,988 | 9/1974 | Buttery | 206/45.31 |

*Primary Examiner*—Stephen P. Garbe
*Attorney, Agent, or Firm*—Gordon W. Hueschen

[57] ABSTRACT

A generally rectangular window container, i.e., folder, comprising a bottom wall, end walls in the form of a isosceles trapezoid or two of the same abutting each other along their major base to form a flattened hexagon, side walls connected to the bottom wall along longitudinal edges thereof, said end walls hingedly connected to said bottom wall along the transverse edges thereof, top end panels attached to said end walls, end flaps attached to said top end panels, said top end panels and said side walls being secured in juxtaposition by securing said end flaps to the side walls or to the container bottom wall. Integral blanks for the erection of such type of window containers therefrom. Packages comprising bacon or the like contained in vacuum-packed transparent pouches within window containers of the invention produced by forming the containers around the desired content from said integral blanks. Method of erecting the window containers of the invention and of packaging bacon or the like therein. The containers preferably contain severance lines for further viewing of the contents by a prospective purchaser, and likewise one or more lines of severance for ready access to the contents of the container.

9 Claims, 15 Drawing Figures

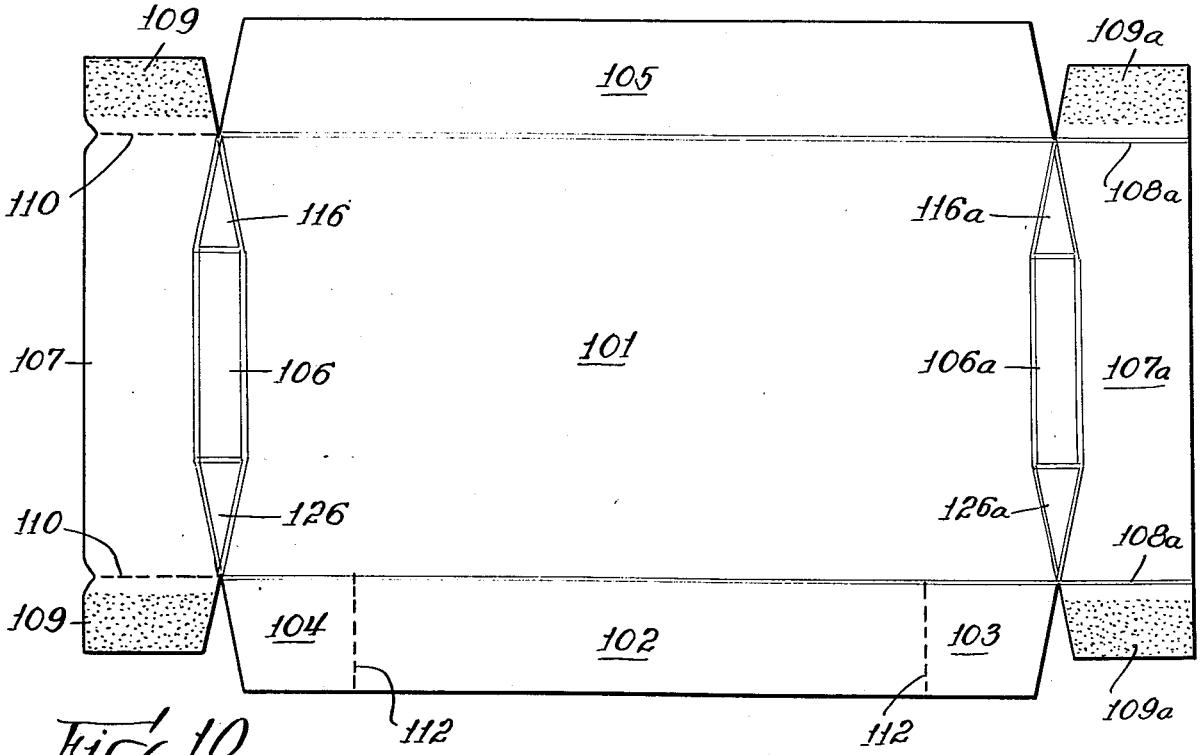
Fig. 10
Fig. 11
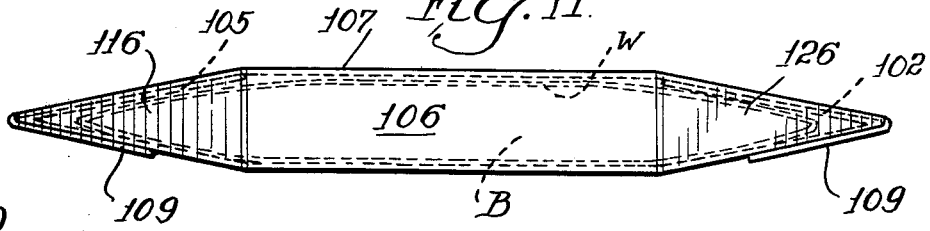
Fig. 12
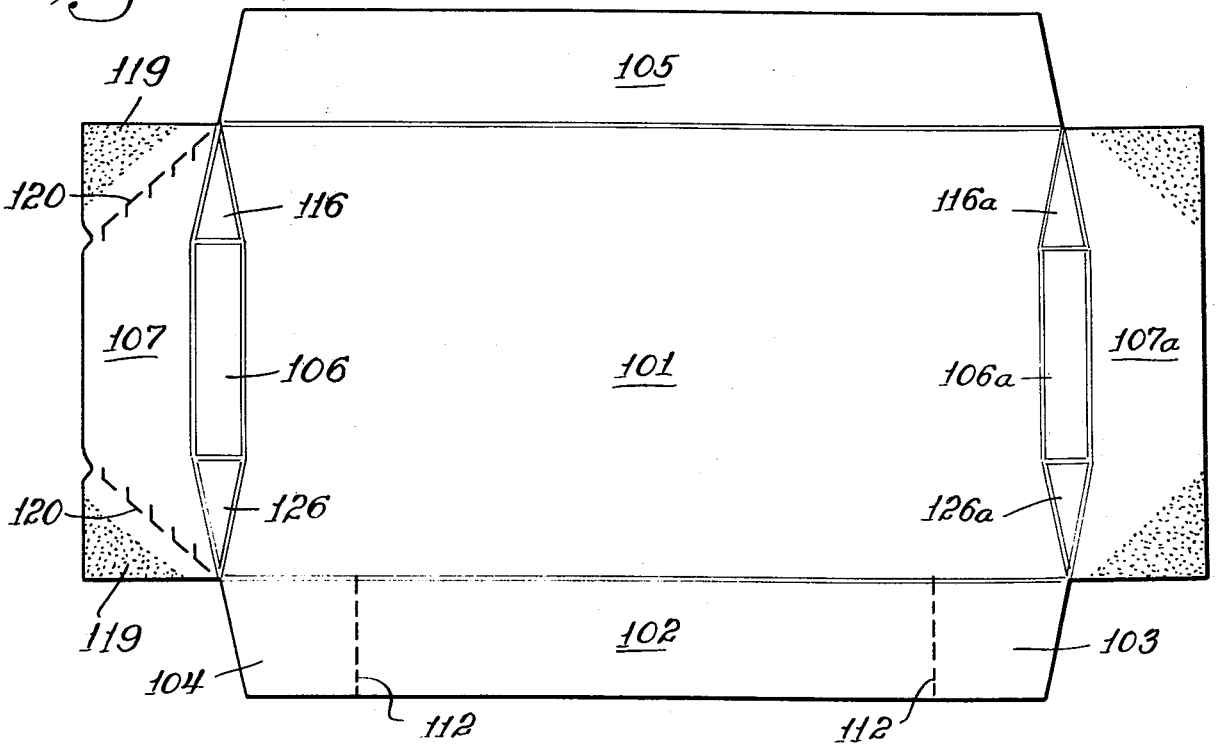

BACON OR LIKE CONTAINER, BLANK THEREFOR, BACON PACKAGE AND METHOD OF PACKAGING BACON THEREIN

BACKGROUND OF THE INVENTION (1) Field of Invention

Bacon or like containers; blanks from which the same may be erected. Bacon-containing package comprising such container. Such containers having a window therein for viewing of contents. Such containers which may be readily constructed of inexpensive sheetform material such as paperboard and which may be readily and conveniently erected from an integral blank.

(2) Prior Art

Bacon packages, cartons, containers, or folders have taken innumerable forms. Most recently, regulations have required minimum visibility or that bacon packages provide means whereby the viewing consumer can, if desired, view the less meaty and more fatty portions of packaged bacon by turning back a portion of the covering package or in similar manner, to obviate possible misleading of the customer by a showing of only the most desirable portions through the package window. Over-wrapped bacon boards, wherein the product is merely laid out in usual shingles and viewed through transparent wrapping as well as through a suitably-placed opening in the rear of the bacon board, have also come into use, as well as numerous window-containing cartons and the like. Representative of prior art in this field may be mentioned U.S. Pat. No. 3,835,988, drawn to a window carton, and U.S. Pat. No. 3,803,332, drawn to a bacon package having a transparent front window and whereby the reverse of the bacon shingle may be viewed from the rear through a window strategically placed in the backing board. All of the previous containers designed to act as window cartons or for the packaging of bacon or the like have, however, suffered from numerous disadvantages whether of economy, difficulty of construction, failure to provide a sufficient view of the contents or means whereby such view may be obtained, difficulty of opening, and general inelegance of the container and the package containing the desired product. It is obvious that a simplified elegant container for the packaging of bacon or like products as are commonly packaged in such window containers, which is able to dispense with bacon backing boards, trays, and over-wraps, all as have been conventionally employed in the art, would not only be highly desirable but would also fulfill a need resulting from the inadequate previously-available containers of this type.

OBJECTS OF THE INVENTION

It is accordingly an object of the present invention to provide a container of usual inexpensive sheetform material such as paperboard for packaging items such as sliced meat products, in particular bacon, or the like, and designed to provide a window opening in the container, hereinafter referred to as a "folder", for inspection of the contents therein. It is another object of the invention to provide such a folder which is not subject to any of the disadvantages of prior art containers designed for the same packaging purposes. A further object of the invention is the provision of an improved window folder of paperboard or the like having an improved structure and which does not suffer from the shortcomings of previously available cartons or containers of the same general type and for the same purpose, including general inelegance, unsightliness or complete inutility after original opening for use, and the necessity of having an inner "bacon board" or tray and/or an outer "over-wrap" of transparent material, all of which are presently quite common in the art. A still further object of the invention is to provide an improved bacon package wherein the bacon is properly and conveniently displayed and wherein access is readily obtainable for viewing of additional portions of the bacon shingle not originally displayed, if desired, as well as means for ready and convenient opening of the package to gain access to the bacon or similar product packaged therein. An additional object of the invention is the provision of such an improved window folder having end walls of a polygonal nature, especially trapezoidal including hexagonal, to provide vertical elevation to the folder at the end thereof, whereas the side walls thereof simply fold over and are conveniently secured to end flaps provided on top end panels attached to said end walls, which end flaps are preferably secured adhesively either beneath or on top of the folded-over side walls of the container. Still an additional object is the provision of such folder having contained therein pre-packaged bacon in the form of a transparent pouch thereof, preferably vacuum packed, thus providing a clean, elegant appearing, unique package for point-of-sale dispensing. Still a further object of the invention is the provision of a method of erecting such a folder and for the packaging of bacon or like products therein. Yet a further object of the invention is the provision of integral blanks adapted and suitable for erection into the folders and packages of the present invention as already described. The accomplishment of the foregoing and additional objects will become more fully apparent hereinafter, and still other objects will be apparent to one skilled in the art to which this invention pertains as the description proceeds and from the ensuing specification, drawings, and claims hereof.

SUMMARY OF THE INVENTION

The present invention contemplates a window folder having a generally rectangular structure when viewed in top plan, having a generally rectangular bottom wall and two elongated side walls articulated to said bottom wall along score lines, usually along its longitudinal score lines, said bottom also having end walls of a trapezoidal including hexagonal configuration also articulated thereto along score lines, usually the transverse score lines, for providing certain necessary vertical elevation at the ends of the folder, said end walls having connected thereto top end panels with end flaps adapted either to be folded over on top of or underneath said side walls and to be adhesively secured thereto or to said bottom wall. In some embodiments, these end flaps may be secured beneath the side walls whereas, in other embodiments, they may be secured on top or outside of the side walls or even, by means of extensions which extend beyond the juncture of said side walls and said bottom wall, to the bottom wall of the container itself. In all usual embodiments, severance or fracture lines (lines of weakness) are provided in at least one of the side walls, usually extending from its leading edge to near or approximately its juncture with the bottom wall, for purposes of enabling a prospective customer to tear said side wall, or a part thereof, along said fracture lines and lift it, or a part thereof, up for a better view of the contents of the folder. In other embodiments, additional fracture lines are provided by means of cut scores or perforations or the like for purposes of enabling ready access to the contents of the container merely by ripping off an end of the container along said fracture lines. Various embodiments are provided, with trapezoidal (including hexagonal) end walls, and numerous options are provided as to precisely how the side walls and top end panel end flaps may be conveniently adhesively secured to each other, as well as how access may be conveniently gained to the contents of the package comprising such folders. In addition, the invention comprises the completed package containing bacon or the like contained therein in a transparent pouch, preferably vacuum packed, and the invention further contemplates a method of erecting such folders from integral blanks and for packaging bacon and like products therein.

BRIEF DESCRIPTION OF THE DRAWINGS

The invention, in preferred embodiments, is illustrated by the accompanying drawings, in which:

FIG. 10 is an inside top plan view of an integral blank for forming the folder of FIG. 9.

FIG. 11 is an end view of the folder of FIG. 9 produced from the integral blank of FIG. 10 showing in phantom lines vacuum-packed bacon packaged therein.

FIG. 12 is an inside top plan view of an integral blank suitable for forming another folder embodiment of the present invention.

DESCRIPTION OF THE PREFERRED EMBODIMENTS AND SPECIFIC REFERENCE TO THE DRAWINGS

Figure 1:
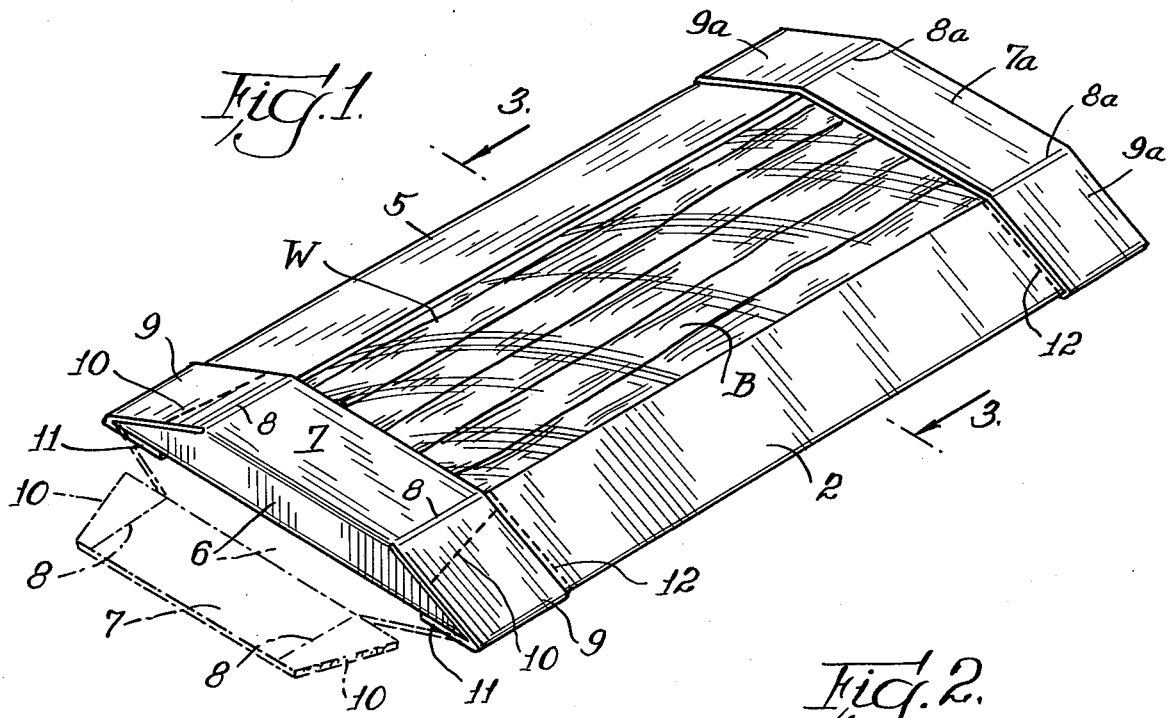
FIG. 1 is a perspective view of a package comprising a folder according to the invention, having a shingle of bacon packaged therein, also showing by phantom lines the opened package produced by tearing out one end wall thereof along fracture lines 10.
Figure 13:
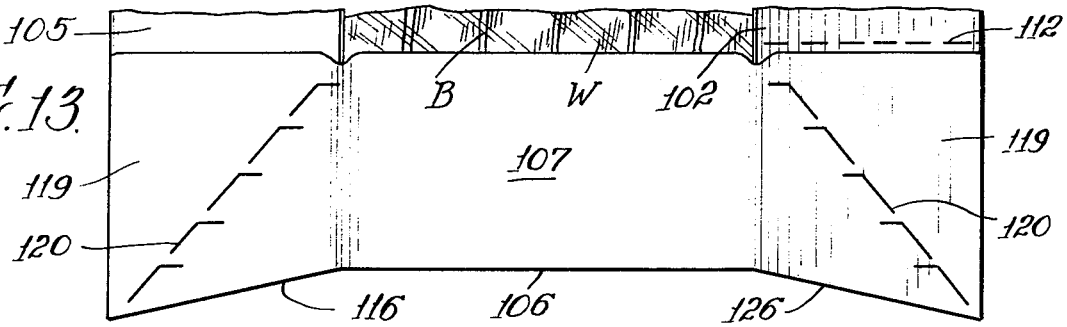
FIG. 13 is a top view of one end of a bacon package comprising a folder of the invention erected from the blank of FIG. 12.

From the accompanying drawings, it will be noted that FIGS. 1 through 8 refer to blanks, erected folders, and packages having trapezoidal end walls, whereas FIGS. 9 through 15 refer to blanks, folders, and packages having hexagonal end walls. In FIGS. 1–8, the end walls are in the form of isosceles trapezoids wherein the two non-parallel sides are equal and slant inwardly, generally adapting the end wall to follow the contour of the intended contents of the folder when erected. In FIGS. 9–15, end walls are generally of a flattened hexagonal nature, and can be considered two juxtaposed isosceles trapezoids abutting each other along their longest base. When in the form of a trapezoid, the longest base is articulated to the bottom wall and, when in the form of a hexagon, considering a hexagon as a double trapezoid, the end wall is articulated to the bottom wall along one full side of the flattened hexagon. It is also to be noted that, except for the type of end wall and minor differences in the arrangements of lines of fracture, the embodiments depicted in the drawings may be correlated generally as follows: FIG. 1 with FIG. 9, FIG. 2 with FIG. 10, FIG. 3 with FIG. 11, FIG. 4 with FIG. 12 and with FIG. 14 (except for relocation of the fracture line), FIG. 5 with FIG. 12 (except for straight instead of angled fracture line), FIG. 6 has no corresponding figure, but would roughly correspond to an end view of a carton erected from the blank of FIG. 12, and FIG. 7 corresponds to FIG. 15. FIG. 13 would roughly correspond to a top plan view of a carton erected from the blank of FIG. 4.

Reference is now made to the accompanying drawings for a better understanding of the invention, wherein all of the parts are numbered and wherein the same numbers are used, to the extent possible, to refer to corresponding parts throughout, the same numbers being increased by a factor of 100 in the hexagonal end-wall series of FIGS. 8–15.

Figure 2:
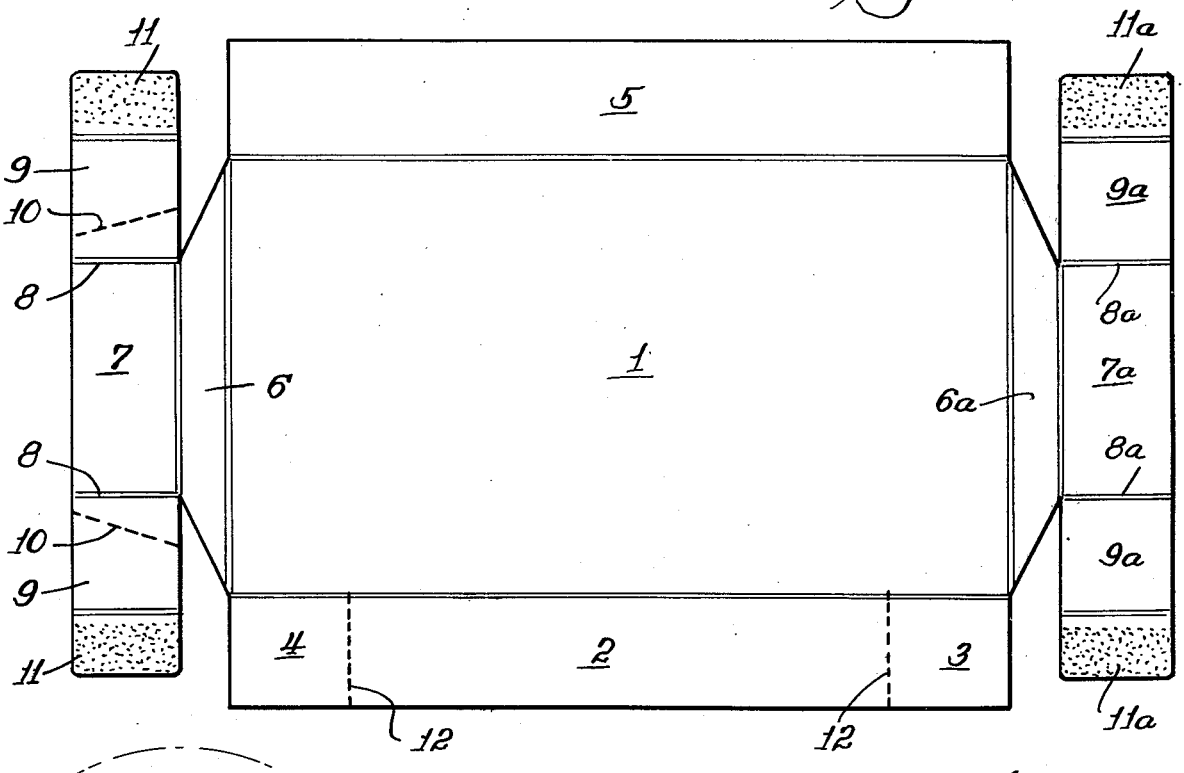
FIG. 2 is a top plan view of an integral blank used to form the folder of FIG. 1, viewed from the inside.

Referring now to FIG. 2, there is shown an integral blank of paperboard or the like. Generally the paperboard will be of usual type having a filler and inner and outer liners. The outer liner will generally be coated with clay or the like. One or both of the liners may advantageously also be wax-coated. This blank comprises bottom wall 1 having appended or connected thereto side walls 5 and 2 along its longitudinal edges. Side wall 2 is provided with lines of fracture 12, 12 comprising perforations, cut scores, or the like, thus defining detachable segments 3 and 4 at the respective ends of side wall 2. Connected to bottom wall 1 along a score line at each of its transverse edges along its major base is an isosceles trapezoidal end wall, respectively designated 6 and **6*a*. Connected to the minor base of each of said end walls 6 and 6*a* along a score line is a top end panel, respectively designated 7 and 7*a*. Connected along score lines 8, 8 and 8*a*, 8*a* to each of top end panels 7 and 7*a* are end flaps 9, 9 and 9*a*, 9*a*, each having a glue flap 11, 11 and 11*a*, 11*a* connected thereto along a score line at the outer extremity thereof. The glue flaps may be suitably provided with a hot melt or other adhesive, glue, or the like, as shown. Each of the two end flaps 9, 9 is provided with a line of severance 10, 10, in the form of cut scores, perforations, or the like. It will be obvious that similar lines of severance can be provided, if desired, in end flaps 9*a*, 9*a***. In the blank of FIG.

2, it will also be apparent that adhesive may be provided on end flaps 9, 9 up to the severance lines 10, 10 if desired, as well as over the entire surfaces of end flap 9a, 9a, if desired. Moreover, it will be apparent that the adhesive, if desired, may instead be provided on the inside of side wall 5 at the ends thereof and on the inside of side wall 2 in areas 3 and 4 thereof. Still alternatively, it will be apparent that, if desired, the adhesive can be provided on the reverse side of glue flaps 11 and 11a and optionally also on the reverse sides of end flaps 9 and 9a if it is desired to fold these flaps in first upon erection of the container.

The completed package comprising the folder erected from the blank of FIG. 2 is shown in FIG. 1. The contents of the package, here bacon B, is visible through the window of the package. The bacon is vacuum-packed in transparent material such as polyethylene or polyvinylchloride film, cellophane, or the like, and the transparent film W is apparent through the window of the folder.

The phantom lines in FIG. 1 show the result of ripping out one end of the container by grasping the top end panel 7 and fracturing along severance lines 10, thereby gaining ready access to the contents of the package.

Figure 3:
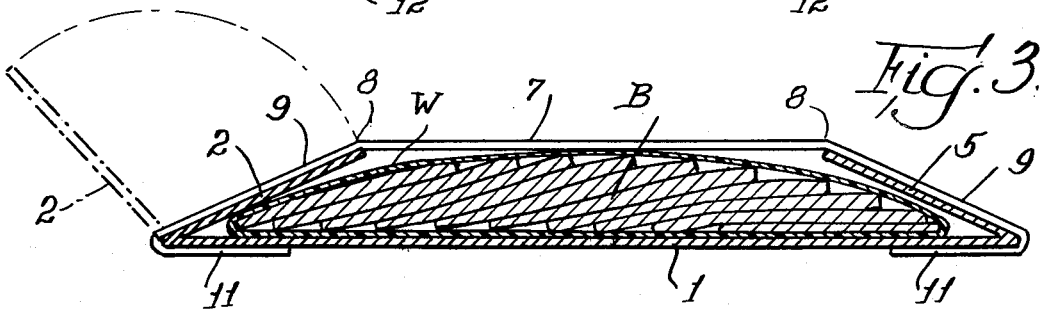
FIG. 3 is a sectional view of the package of FIG. 1 along lines 3, 3 of FIG. 1, showing the bacon shingle in its transparent tubular pack in place therein and showing in phantom lines how side wall 2 can be opened along fracture lines 12, 12 for better viewing of the contents.

FIG. 3, a sectional view along lines 3, 3 of FIG. 1, shows the bacon shingle contained in its vacuum-pack within the folder, and the phantom lines show the central portion of side wall 2 laid back for better visibility of the package contents by tearing along severance lines 12, 12.

Figure 4:
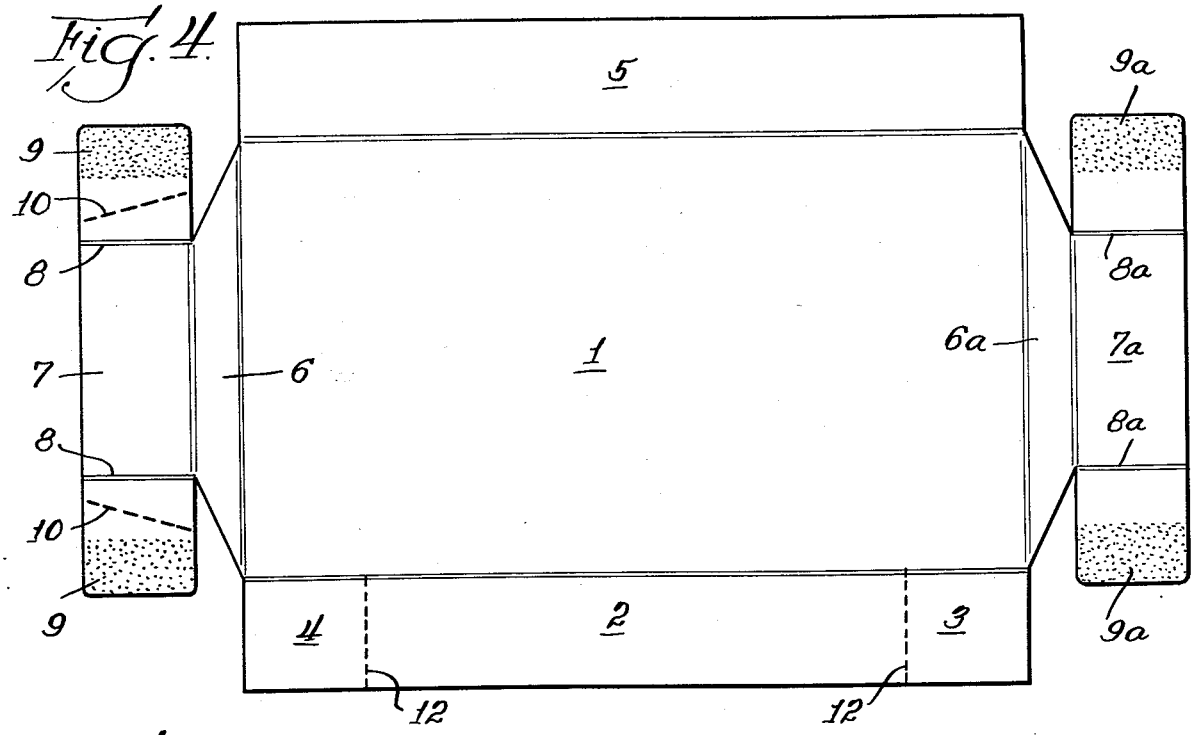
FIG. 4 is an inside top plan view of an integral blank according to a preferred embodiment of the invention.
Figure 5:
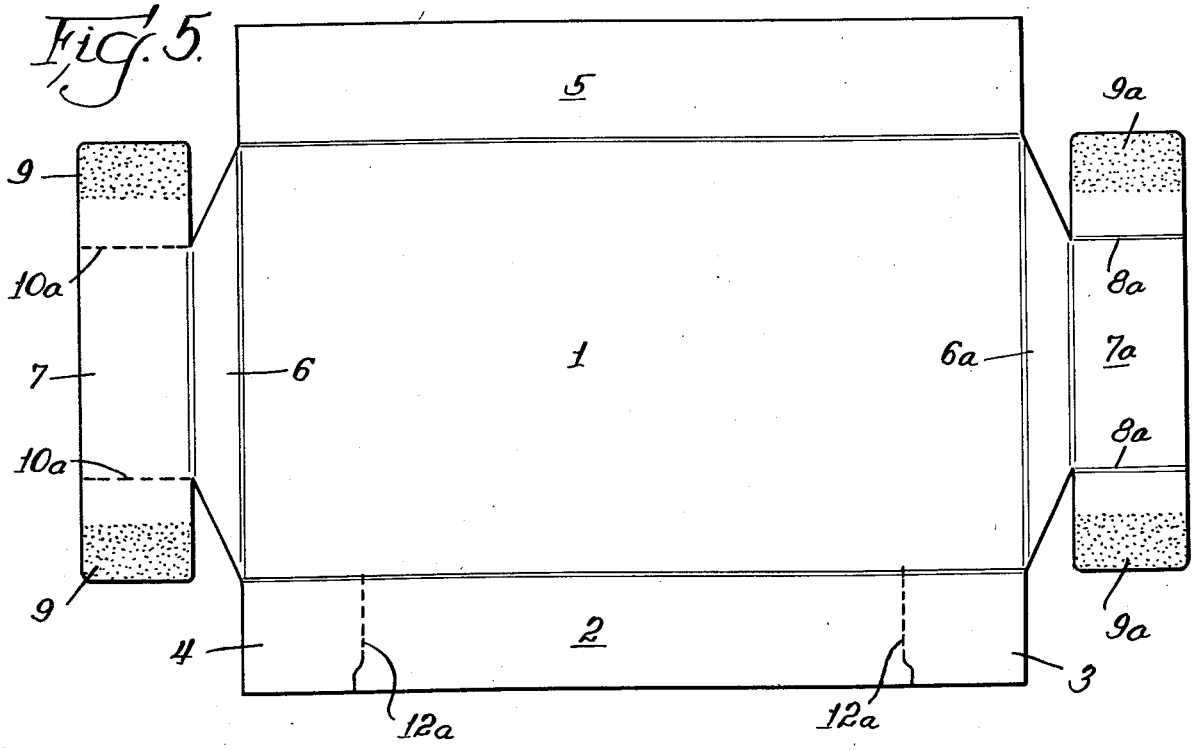
FIG. 5 is an inside top plan view of an integral blank for forming another preferred folder embodiment of the present invention.

FIGS. 4 and 5 show preferred blanks according to the invention from the standpoint of employment of a smaller amount of material of construction. As will be noted, all the elements are still present with the exception of glue flaps 11, 11 and 11a, 11a, which are not necessary since sealing will be effected in the versions of FIGS. 4 and 5 only between end flaps 9, 9, 9a, 9a and side walls 2 and 5 rather than between glue flaps 11, 11, 11a, 11a and bottom wall 1, as in the case of the version of FIG. 2, shown erected in FIG. 1. The only difference between the version of FIG. 5 and that of FIG. 4 is the slightly different form of severance lines 12a, 12a and in that severance lines 10a, 10a are not diagonally disposed in end flaps 9, 9, but rather replace the score lines 8, 8 in the version of FIG. 4 at the juncture of the flaps with their top end panel. Such structure is especially perferred when the adhesive areas are reversed and provided on side wall 2, 5 extremities instead of flaps 9, 9a, end panels 7, 7a and attached end flaps then being folded in first, rather than last, in erecting the folder.

Figure 6:
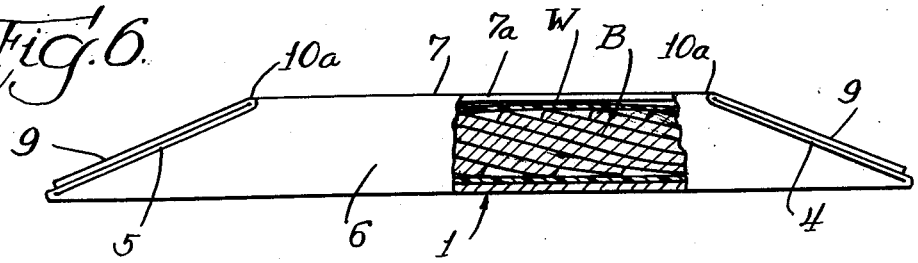
FIG. 6 is an end view of a folder erected from the blank of FIG. 5, showing in partially cut away cross-section a shingle of bacon in its vacuum-pack container in place therein.

FIG. 6 shows an end view of the container erected from the blank of FIG. 5 with end flaps 9, 9 superposed over side wall 5 and end portion 4 of side wall 2 and adhesively secured thereto. End wall 6 as well as bottom wall 1 and top end panel 7, as well as the junctures 10a, 10a between top end panel 7 and end flaps 9, 9 are clearly visible in FIG. 6. The packaged contents bacon B and transparent wrap W are seen in the partially cut away section. Elements 4, 5 and 9, 9 would of course be just reversed if the adhesive areas and folding sequence were reversed, as just discussed re FIG. 5.

Figure 7:
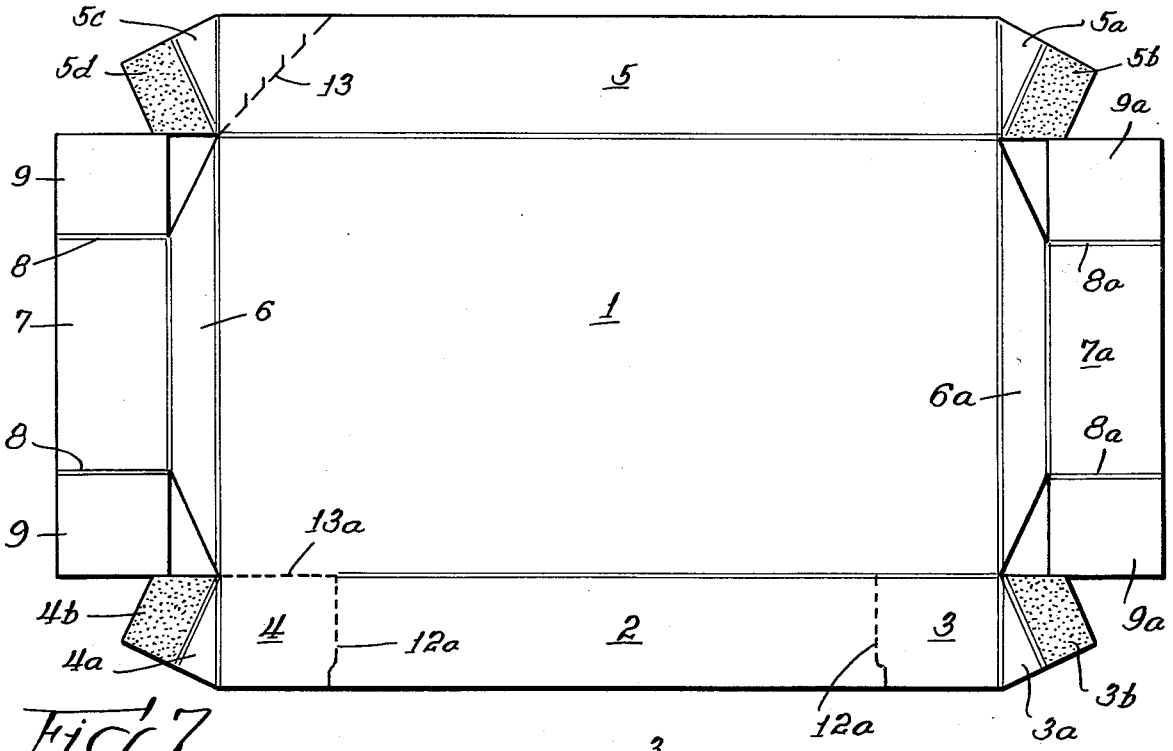
FIG. 7 is an inside top plan view of another integral blank for forming a folder which is a further variant of the present invention.

FIG. 7 shows a top plan view of another blank according to the invention, once again viewed from the inside. Here again, all of the elements of FIG. 2 are present, with the exception of the glue flaps 11, 11, 11a, 11a, but in this case severance line 13 in side wall 5 has replaced severance lines 10, 10 in end flaps 9, 9. In addition, severance line 13a has been provided between segment 4 of side wall 2 and bottom wall 1. Moreover, triangular side wall extensions 3a, 4a, 5a, and 5c, having angles corresponding to the angles of the trapezoidal end wall 6, each with its appended glue flap 3b, 4b, 5b, and 5d, connected thereto along a score line, are attached respectively to the opposite ends of side walls 5 and segments 3 and 4 of side wall 2.

Figure 8:
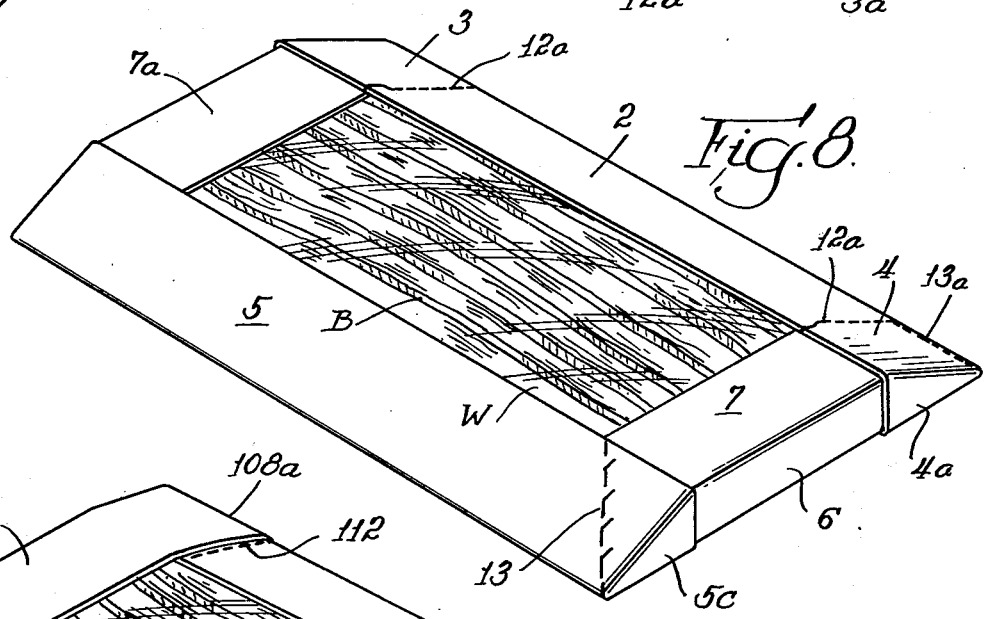
FIG. 8 is a perspective view of a package comprising the folder set up and formed from the blank of FIG. 7.

FIG. 8 shows a filled package comprising a folder erected from the blank of FIG. 7, glue flaps 5d, 4b, 3b, and 5b, being adhesively secured to the bottom of bottom wall 1. Triangular extensions 4a and 5c, superposed over the ends of end wall 6, are clearly visible. The tear-out section in the construction of FIG. 8 constitutes, for viewing, side wall 2, which may be ripped upwardly along severance lines 12a, 12a, and the tear-out end section defined by top end panel 7, segment 4 of side wall 2 defined by severance lines 12a and 13a, and the segment of side wall 5 adjacent to top end panel 7 and defined by severance line 13.

FIG. 10 shows another form of blank according to the invention, again viewed from the inside, wherein the end walls, instead of being in the form of isosceles trapezoids, as in FIG. 1, are in the form of flattened hexagons, comprising a central rectangular section 106, 106a, at each end of which is located and connected thereto by a score line along its shorter base, an isosceles triangle 116, 126, 116a, and 126a. These end walls, so constituted, are connected to bottom wall 101 along score lines, as well as to top end flap 107, 107a, also along score lines. The blank is otherwise identical to the blank of FIG. 2 with the exception that glue flaps 11, 11, 11a, 11a are omitted and that severance lines 110, 110 replace score lines 8 and continue as extensions of the score lines between side walls 102 and 105 and bottom wall 101. Adhesive area, as shown, is located on end flaps 109, 109, and 109a, 109a. At the other side of the blank, as shown, severance lines are not provided, but rather score lines 108a, 108a between top end panel 107a and end flaps 109a, 109a.

Figure 9:
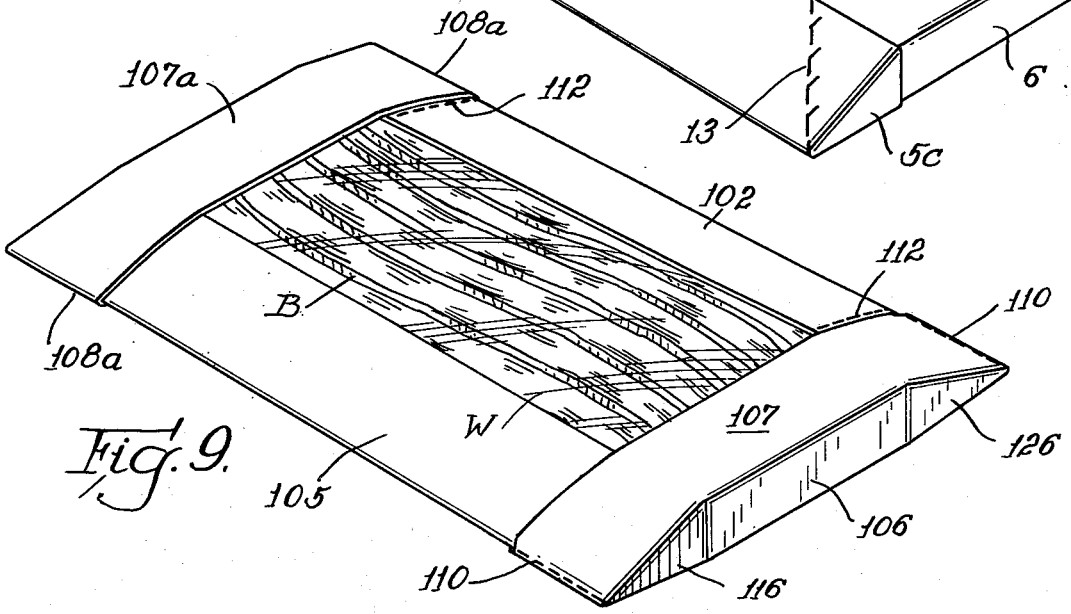
FIG. 9 is a perspective view of a modification of the invention showing a folder with a hexagonal end wall.

FIG. 9 is a perspective view of a filled package comprising the set-up folder from the blank of FIG. 10. The flattened hexagonal end wall comprising rectangular segment 106 and appended isosceles triangular segments 116 and 126 is clearly visible. Severance lines 110, 110 allow the package to be readily opened simply by pulling upwardly or backwardly on top end panel 107. Similarly, for better viewing of contents, side wall 2 may readily be lifted to cause fracture along severance lines 112, 112.

FIG. 11 is an end view of the package of FIG. 9, showing rectangular end wall segment 106 and its appended isosceles triangular segments 116 and 126, as well as end flaps 109, 109 which are adhesively affixed to the bottom of bottom wall 101 (not seen in this view). Content bacon B and wrap W is shown in shadow lines therein.

FIG. 12 is a top plan view of another blank according to the invention, seen from the inside, preferred for its economy of material of construction. The blank is substantially identical to the blank of FIG. 10, except that lines of severance 120, 120 are provided convergingly diagonally in top end panel 107 and end flaps 119, 119 are appended to top end flap 107 along these severance lines. Moreover, end flaps 119 have been shortened considerably with respect to end flaps 109 in the embodiments of FIG. 10, and these are shown adapted for adhesive securement to side wall 105 and segment 104 of side wall 102 upon erection of the folder. At the other end of the folder, top end flap 107*a* is itself provided with adhesive areas, in the normally "end flap" areas thereof, for adhesive securement to the outside of side walls 105 and segment 103 of side wall 102 upon erection of the folder. No severance lines or score lines are provided in top end flap 107*a*, although they could readily be so provided if desired.

FIG. 13 shows a top view of the opening end of a bacon package comprising an erected folder set up from the blank of FIG. 12. The package is readily opened by grasping the inner edge of top end panel 107 and pulling upwardly and outwardly along severance lines 120, 120, thereby providing ready access to the contents of the package.

Figure 14:
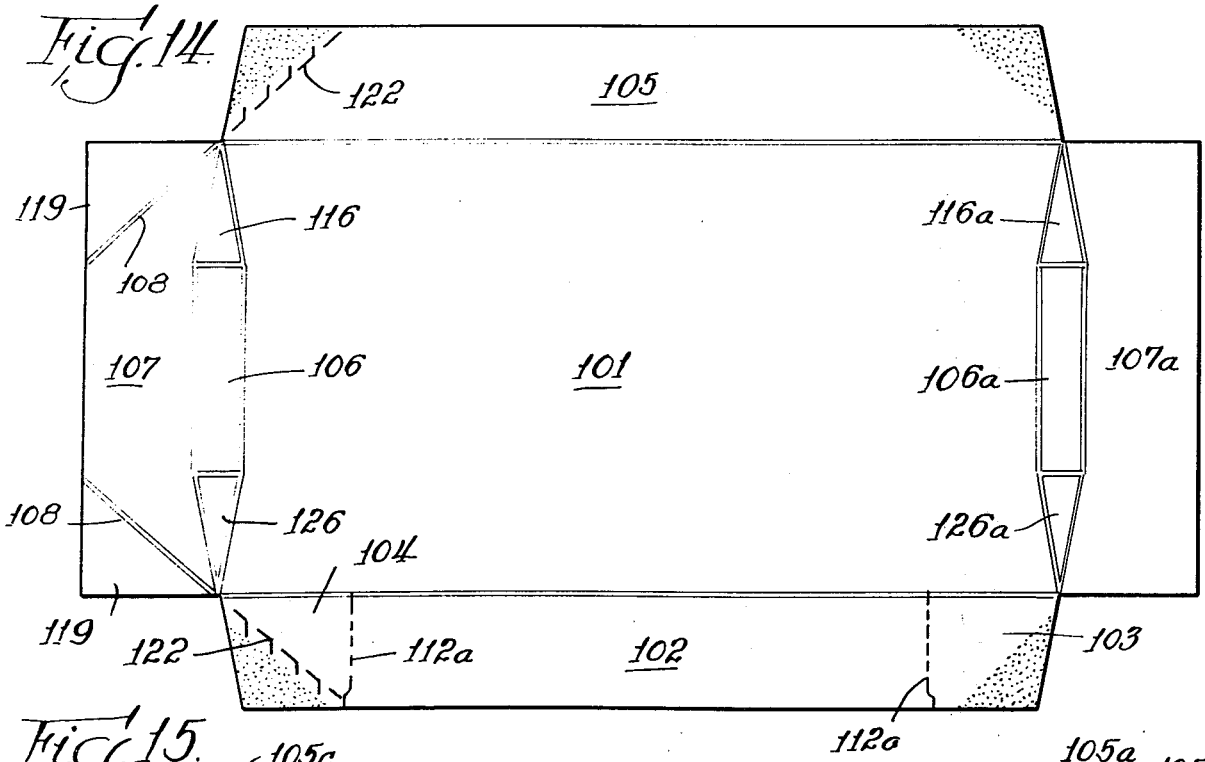
FIG. 14 is an inside top plan view of another integral blank suitable for providing a further folder modification of the invention.
Figure 15:
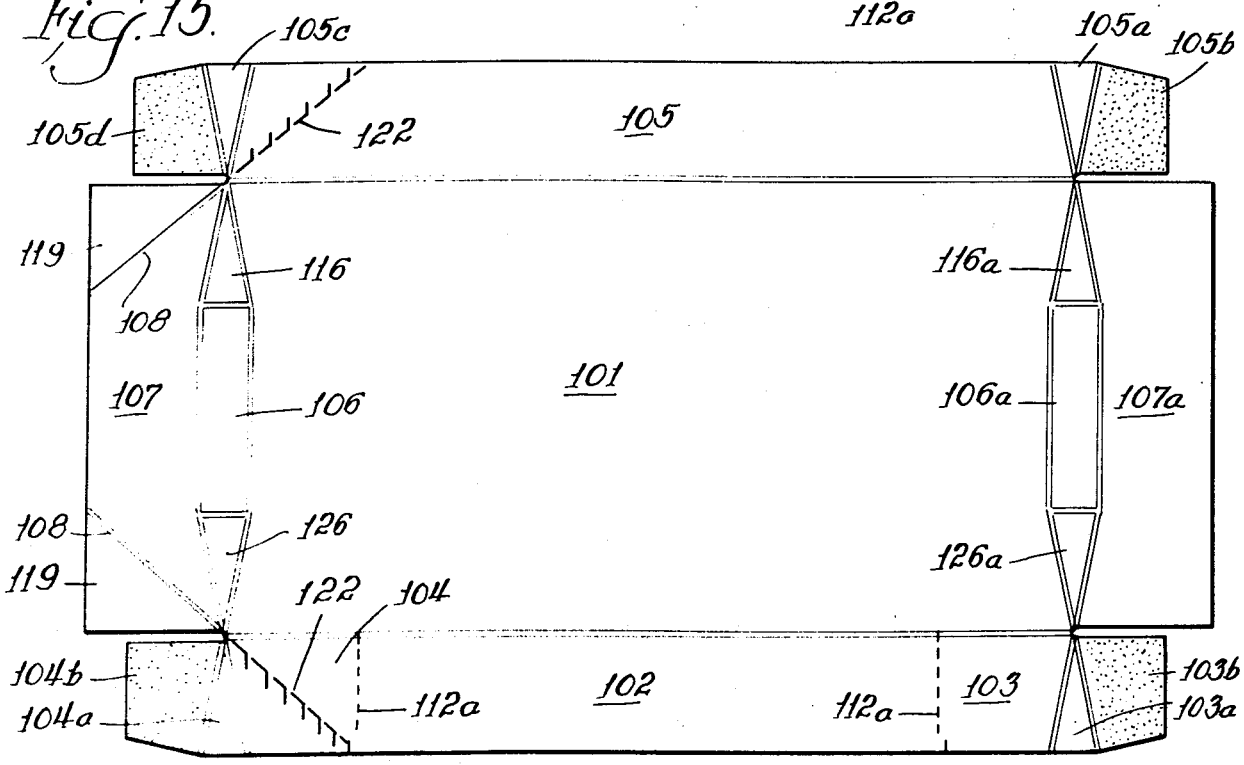
FIG. 15 is an inside top plan view of a further integral blank suitable for erection into yet an additional folder embodiment of the present invention.

FIGS. 14 and 15 show additional blanks according to the invention, viewed from the inside. The blank of FIG. 14 corresponds roughly to the blank of FIG. 4 having the trapezoidal end walls, and the blank of FIG. 13 corresponds roughly to the blank of FIG. 7, likewise with the major exception of the difference in the end walls thereof. In both of these versions, the one top end panel, 107*a*, remains intact and integral, with no end flaps appended thereto. At the other side of the blank, top end flap 107 is in each case appended along score lines to end flaps 119. Top end flaps 107 and 107*a* are, of course, connected to the flattened hexagonal end walls along score lines, and the end walls are in turn connected along score lines to bottom wall 101. Severance lines 122 are provided in the blank of FIG. 14 in segment 104 of side wall 102 and in side wall 105. The same severance lines are provided in the same positions in the blank of FIG. 15. In the blank of FIG. 14, adhesive areas are provided at the ends of side wall 105 and in segments 103 and 104 of side wall 102, at the one end in the area defined by severance lines 122, thus to facilitate erection of the folder after placement of the contents upon the bottom wall thereof by folding in top end panels 107 and 107*a* and adhesively securing side walls 102 and 105 in overlying relation thereto.

In the version of FIG. 15, the ends of side wall 105 and segments 103 and 104 of side wall 102 are additionally provided with corresponding isosceles triangular areas, hinged thereto along score lines and each, in addition, having glue flaps affixed thereto along score lines, considerably like the version shown in FIG. 7. The additional triangular areas or extensions are 103*a*, 104*a*, 105*a*, and 105*c*, and their respective appended glue flaps are 103*b*, 104*b*, 105*b*, and 105*d*. In this particular version, the folder is adapted to be erected and closed, after placement of the desired content upon the bottom thereof, by folding in of top end panels 107 and 107*a* and then folding side walls 102 and 105 thereupon, and adhesively securing glue flaps 103*b*, 104*b*, 105*b*, and 105*d* to the bottom of bottom wall 101 to produce a completed package remarkably like that shown in FIG. 8 except for the presence of the flattened hexagonal side wall instead of the isosceles trapezoidal wall of the embodiment shown in FIG. 8.

It will be apparent to one skilled in the art that, in addition to the manner and sequence of folding and adhesively securing the various elements of the folder of the invention to each other, as precisely shown and described with respect to each of the several embodiments thereof, the sequence and/or the position of the hot melt or other adhesive can be reversed, just as more fully described for the embodiment of FIGS. 1–3, 5 and 6, without in any way departing from the spirit and scope of the invention. The ultimate choice of where the adhesive is located and how it will be applied and what precise sequence of folds will be employed will be determined by economic considerations, such as whether a single or a double pass will be required to provide all the adhesive on a single side or on two opposite sides of the blank, and upon the sequence of folds decided ultimately to be employed. However, it will also be apparent that, regardless of the exact sequence of folds desired to be employed, with the various embodiments of the present invention, it is always desirable to provide the adhesive or sealing areas in a suitable location of the starting blank so that a plurality of passes for cutting and application of glue, hot melt, or other adhesive is not required.

In operation, for assembly of the carton, container, or folder, as it may be variously called, from the blank of the invention, filling the same with desired produce, and sealing the same, the following sequence is employed:

First, the desired blank is selected. Then, the desired content, usually bacon or other cold meat, prepackaged in an amount of known weight in a transparent container, e.g., pouch, of the usual material, preferably vacuum-packed, is placed upon the container bottom wall 1 or 101. Side walls 2, 5 or 102, 105 are then folded inwardly upon the predetermined content, preferably a bacon shingle. The isosceles trapezoidal end walls or flattened hexagonal end walls, each with their appended top end panel, and, to the extent necessary, their appended end flaps and glue flaps, are thereupon folded over upon the side walls and adhesively secured thereto by means of adhesive located on the interior surface of the appended glue flaps and/or end flaps, either to the top surface of side walls 2, 5 or 102, 105 or, alternatively, to the bottom of bottom wall 1 or 101. Alternatively, the end walls with their appended top wall panels, and, to the extent necessary, their in turn appended end flaps and glue flaps, are folded in and the side walls 2, 5 or 102, 105, if desired with their own appended end extensions and glue flaps, are then folded over and adhesively secured either to the top end panels or end flaps thereof or, alternatively, to the container bottom wall 1 or 101, e.g., on the bottom or exterior thereof. As already pointed out, for opening the container for further inspection of the contents thereof, it is only necessary to grasp side wall 2 or 102 and pull upwardly to fracture along lines of severance 12, 12*a*, or 112, 112*a*. For removal of the contents of the package for use, it is in each case only necessary to pull outwardly and/or upwardly upon the selected top end panel 7 or 107, since effective lines of severance are provided according to the invention enabling the end of the container to be conveniently removed by ripping or tearing along the said severance lines. Optionally, such severance lines can be provided in the opposite panels 7*a* and 107*a*, alone or in addition to those in 7, 107, as will be apparent to one skilled in the art.

It should be apparent from the foregoing that, in all embodiments, the end wall comprises a trapezoidal including hexagonal end wall member appended along a score line to the bottom wall and at its other side to a top end panel member, side walls appended to the bottom member along score lines and adapted to be folded in along said score lines, one of said side walls having severance lines adapted to be fractured for a better view of the contents of the finished package, and suitable end flaps articulated either to the top end panels or side walls or both, with suitable adhesive bearing areas for adhesively securing the top end panels to the container side walls, or in close juxtaposition thereto, thereby to form a window folder, normally about a pre-packaged product desired to be contained therein.

Due to the unique configuration of the end walls of the folder, the side walls may be folded directly thereupon or upon the contents of the folder, and be adhesively secured to top end panels or end flaps attached to the top end panels or glue flaps appended to the end flaps, thereby to maintain close juxtaposition between the side walls and the top end panels of the structure, providing a unique and attractive finished package in which, as will be noted, vertical side elevations between the bottom wall and the side walls are eliminated, these members being advantageously merely hingedly connected and then folded over along score lines.

It is therefore apparent from the foregoing that the objectives of the present invention have been fulfilled and that suitable window folders for bacon or the like, blanks for the erection of the same, bacon or like products packaged therein, and a method for packaging bacon or like products therein, have all been attained. Moreover, it should be apparent that elimination of the usually necessary tray or bacon backing board and the possibility of employing paperboard of considerable diminished caliper than previously used and believed necessary for similar types of structures provides great economic advantage. Also, that the possibility of filling the folders of the invention with pre-packaged produce prior to erection and closing of the folder, due to the unique configuration of the end walls thereof, permits direct adhesive sealing of the various folder members to each other by applying pressure or heat and pressure directly against the exterior of the folder and against the produce contained therein. The other advantages of the present invention will be apparent from the foregoing and many have already been mentioned. It is, however, to be understood that the invention is not limited to the exact details of the construction, operation, or exact materials or embodiments shown and described, as obvious modifications and equivalents will be apparent to one skilled in the art. For example, other adhering means, for example, pressure-sensitive adhesive, may be employed for securing the various members to each other and securing the top end panels in juxtaposition to the side walls of the folder of the invention. Alternatively, other types of end flaps or glue flaps or end panels may be employed as overlying or underlying end panels or end panel extensions or for securing the top end panel in juxtaposition to the side walls either inside or outside of the same. Similarly, as already pointed out, a plurality of the walls and panels may bear adhesive of pressure-sensitive, hot melt, or glue type, or the like, for securing the various members in place with respect to each other in the erected and finished folder and package, or still other equivalent means may be employed in such non-preferred embodiments, wherefore the invention is to be limited only by the full scope of the appended claims.

I claim:

1. An integral blank for a window folder, having a generally rectangular top plan view and a rectangular window therein, cut and scored to provide:

a bottom wall, a pair of opposed side walls hingedly connected to said bottom wall along opposite edges of said bottom wall, a pair of opposed end walls hingedly connected to said bottom wall along the other opposite edges of said bottom wall and having a configuration defining at least one trapezoid having its shorter base outwardly extending, a relatively narrow outer top end panel hingedly connected to the outwardly extending shorter base of said trapezoid-comprising end wall, end flaps connected to a top end panel, said top end panel or said top end panel end flaps being adapted to be adhesively affixed to said side walls or said bottom wall for securing said side walls and said top end panels in fixed juxtaposition with respect to each other, thereby to provide a stable window folder upon erection of the same from said blank, wherein a severance line is provided in a side wall for provision of a readily liftable section of said side wall in a folder erected from said blank.

2. A folder erected from the integral blank of claim 1.

3. A bacon package comprising bacon vacuum-packed in a transparent pouch contained in a window folder erected about it from a blank of claim 1.

4. An integral blank for a window folder, having a generally rectangular top plan view and a rectangular window therein, cut and scored to provide:

a bottom wall, a pair of opposed side walls hingedly connected to said bottom wall along opposite edges of said bottom wall, a pair of opposed end walls hingedly connected to said bottom wall along the other opposite edges of said bottom wall and having a configuration defining an isosceles trapezoid having its shorter base outwardly extending and its major base hingedly connected to said bottom wall, a relatively narrow outer top end panel hingedly connected to the outwardly extending shorter base of said trapezoid-comprising end wall, end flaps connected to a top end panel, said top end panel end flaps or side walls having adhesive areas at the extremities thereof and being adapted to be adhesively affixed to surfaces of said side walls or end flaps when folded in, upon erection of a folder from said blank, for securing said side walls and said top end panels in fixed juxtaposition with respect to each other, a severance line being provided in a side wall for provision of a readily liftable section of said side wall in a folder erected from said blank, a severance line also being provided in a top end panel end flap, in the area thereof or in the region of its juncture with its top end panel, for ready access to the contents of a folder erected from said blank, thereby to provide a stable readily-openable and inspectable folder upon erection of a folder from said blank.

5. A folder erected from the integral blank of claim 4.

6. A bacon package comprising bacon vacuum-packed in a transparent pouch contained in a window folder erected about it from a blank of claim 5.

7. Method of packaging bacon which includes the steps of (A) providing a predetermined amount of said bacon prepackaged in a transparent pouch, (B) providing a blank of claim 4, (C) depositing said pouch with its bacon content upon the bottom wall of said blank, and then erecting a window folder from the said blank by (a) folding over said side walls, (b) folding said end walls into upright position and said top end panels and end flaps into juxtaposition with said side walls and into overlying position with respect thereto, and (c) adhesively securing top end panel end flaps to said side walls, thereby to secure said side walls and top end panels in fixed juxtaposition to each other and provide a stable erected window folder with said bacon packaged therein and visible through the window thereof.

8. Method of packaging bacon which includes the steps of (A) providing a predetermined amount of said bacon prepackaged in a transparent pouch, (B) providing a blank of claim 4, (C) depositing said pouch with its bacon content upon the bottom wall of said blank, and then erecting a window folder from the said blank by (a) folding said end walls into upright position and folding over said top end panels and end flaps, (b) folding over said side walls into juxtaposition with said flaps and into overlying position with respect thereto, and (c) adhesively securing said side walls to top end panel end flaps, thereby to secure said side walls and top end panels in fixed juxtaposition to each other and provide a stable erected window folder with said bacon packaged therein and visible through the window thereof.

9. Method of erecting a window folder from a blank of claim 4, comprising the steps of (a) folding said end walls into upright position and folding over said top end panels and end flaps, (b) folding over said side walls into juxtaposition with said flaps and into overlying position with respect thereto, and (c) adhesively securing said side walls to top end panel end flaps, thereby to secure said side walls and top end panels in fixed juxtaposition to each other and provide a stable erected window folder.

* * * * *